US006279797B1

(12) United States Patent
Snyder

(10) Patent No.: US 6,279,797 B1
(45) Date of Patent: Aug. 28, 2001

(54) APPARATUS AND METHOD FOR HANGING HOLIDAY LIGHTS OR OTHER SUCH CORDAGE

(76) Inventor: Ralph M. Snyder, 215 Ventura Ct., Machesney Park, IL (US) 61115

( * ) Notice: Subject to any disclaimer, the term of this patent is extended or adjusted under 35 U.S.C. 154(b) by 0 days.

(21) Appl. No.: 09/528,600

(22) Filed: Mar. 20, 2000

(51) Int. Cl.[7] ..... A45F 5/00
(52) U.S. Cl. ..... 224/268; 224/269; 224/270
(58) Field of Search ..... 224/268, 269, 224/270

(56) References Cited

U.S. PATENT DOCUMENTS

| | | | | |
|---|---|---|---|---|
| D. 275,527 | | 9/1984 | Gee . | |
| D. 306,521 | | 3/1990 | Kenney . | |
| D. 399,055 | | 10/1998 | Coady . | |
| 636,295 | * | 11/1899 | Sibthorpe | 224/268 |
| 1,326,887 | | 12/1919 | Wood . | |
| 2,320,067 | | 5/1943 | Caughren . | |
| 3,285,482 | * | 11/1966 | Bedsaul, Sr. | 224/268 |
| 4,457,462 | | 7/1984 | Taormina . | |
| 4,779,777 | | 10/1988 | Johnson et al. . | |
| 4,974,764 | | 12/1990 | Cantwell . | |
| 5,052,603 | * | 10/1991 | Spina | 224/270 |
| 5,323,943 | * | 6/1994 | Elledge | 224/265 |
| 5,687,892 | | 11/1997 | Johns . | |
| 5,743,451 | | 4/1998 | Kahn . | |
| 5,826,763 | * | 10/1998 | Roberts | 224/270 |
| 6,062,449 | * | 5/2000 | Kahn | 224/268 |

* cited by examiner

*Primary Examiner*—Stephen K. Cronin
(74) *Attorney, Agent, or Firm*—Leydig, Voit & Mayer, Ltd.

(57) ABSTRACT

A novel hanger, kit and method for hanging holiday lights on structures such as Christmas trees. The hanger includes a belt clip or other mount that is adapted to temporarily mount on a person, and a horizontal arm upon which cordage can be wound. The hanger includes a plug retainer which holds the end of the plug. The arm includes a plurality of detents or notches formed therein and spaced apart to partition the separate loops of cordage. The hanger is preferably made from an insulated rigid material such as an insulated wire frame to provide a strong structure but yet one that will not conduct electricity that could otherwise shock the individual to which the hanger is mounted. Utilizing the hanger, first the flexible cordage is looped around the hanger into multiple loops and the hanger is temporarily mounted on a person, such as by clipping the hanger on the belt of the individual. Then, the cordage is removed from the hanger as necessary to install the cordage on a structure. The method may also be used in reverse in which cordage is removed from the structure and looped on the hanger. Once removed, the hanger and the cordage looped thereon maybe stored until reuse is desired.

23 Claims, 3 Drawing Sheets

APPARATUS AND METHOD FOR HANGING HOLIDAY LIGHTS OR OTHER SUCH CORDAGE

FIELD OF THE INVENTION

The present invention relates to holding apparatus and methods of hanging holiday lights or installing other types of cordage.

BACKGROUND OF THE INVENTION

Every year in December during the holiday season, millions of strings of holiday lights are strung on such things as Christmas trees and on the ceilings and roofs of households, businesses and apartments. This can be a manually difficult, labor intensive task, often requiring multiple individuals to complete the task. For example, when hanging lights on Christmas trees, it may be necessary to have a first person actually hanging the lights on the tree and a second person untangling the lights and feeding the lights to the first person. This is particularly true for the elderly and handicapped individuals such as those with Parkinson's disease or those with only one arm or hand. Hanging lights at elevated places such as from a ladder is also a very difficult task which requires skill at manipulating the lights into location. This task can require several individuals to adequately perform. Similar difficulties also arise when individuals attempt to remove the holiday lights once the holiday season has expired, and hung lights are no longer desirable. Yet another problem existing in the art is that it is difficult to store holiday lights without tangling them into a big ball, which then presents difficulties in the following year.

SUMMARY OF THE INVENTION

In view of the foregoing, it is the primary objective of the present invention to provide an easier way to hang strings of holiday lights or otherwise install other forms of cordage.

It is another objective of the present invention to provide an easier way to remove such holiday lights or other such cordage.

It is a subsidiary objective to provide an easier way of storing holiday lights.

In accordance with these and other objectives, the present invention is directed towards a novel hanger which temporarily mounts on a person upon which strings of lights can be looped to assist that individual in hanging holiday lights or other such cordage on various structures. The present invention is also directed towards a novel method of hanging lights or installing flexible cordage utilizing the hanger as a tool. The hanger and novel method of using the hanger allow a single individual to more easily install cordage such as hanging holiday lights on Christmas trees, or on other structures such as the outside or inside of buildings and the like.

According to the novel method, first the flexible cordage is looped around the hanger into multiple loops and the hanger is temporarily mounted on a person, such as by clipping the hanger on the belt of the individual. Then, the cordage is removed from the hanger as necessary to install the cordage on a structure. It is another aspect of the present invention that the method may also be used in reverse in which cordage is removed from the structure and looped on the hanger. Once removed, the hanger and the cordage looped thereon maybe stored until reuse is desired.

The novel hanger of the present invention includes a belt clip or other mount that is adapted to temporarily mount on a person, and a horizontal arm upon which cordage can be looped. It is an aspect of the present invention that the hanger includes a plug retainer which secures the end of the electrical cord to prevent unraveling. It is another aspect of the present invention that the arm includes a plurality of detents formed therein and spaced apart to partition the separate loops of cordage. The hanger is preferably made from an insulated rigid material such an insulated wire frame to provide a strong structure but yet one that will not conduct electricity that could otherwise shock the individual to which the hanger is mounted.

The present invention is particularly advantageous for hanging holiday lights. As such, the invention is also directed at a kit which includes holiday lights and the hanger. The combination can be sold as a single unit in a single sellable package which may induce purchasers to purchase one brand of holiday lights over another brand.

Other object and advantages of the invention will become more apparent from the following detailed description when taken in conjunction with the accompanying drawings.

BRIEF DESCRIPTION OF THE DRAWINGS

The accompanying drawings incorporated in and forming a part of the specification, illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 1:
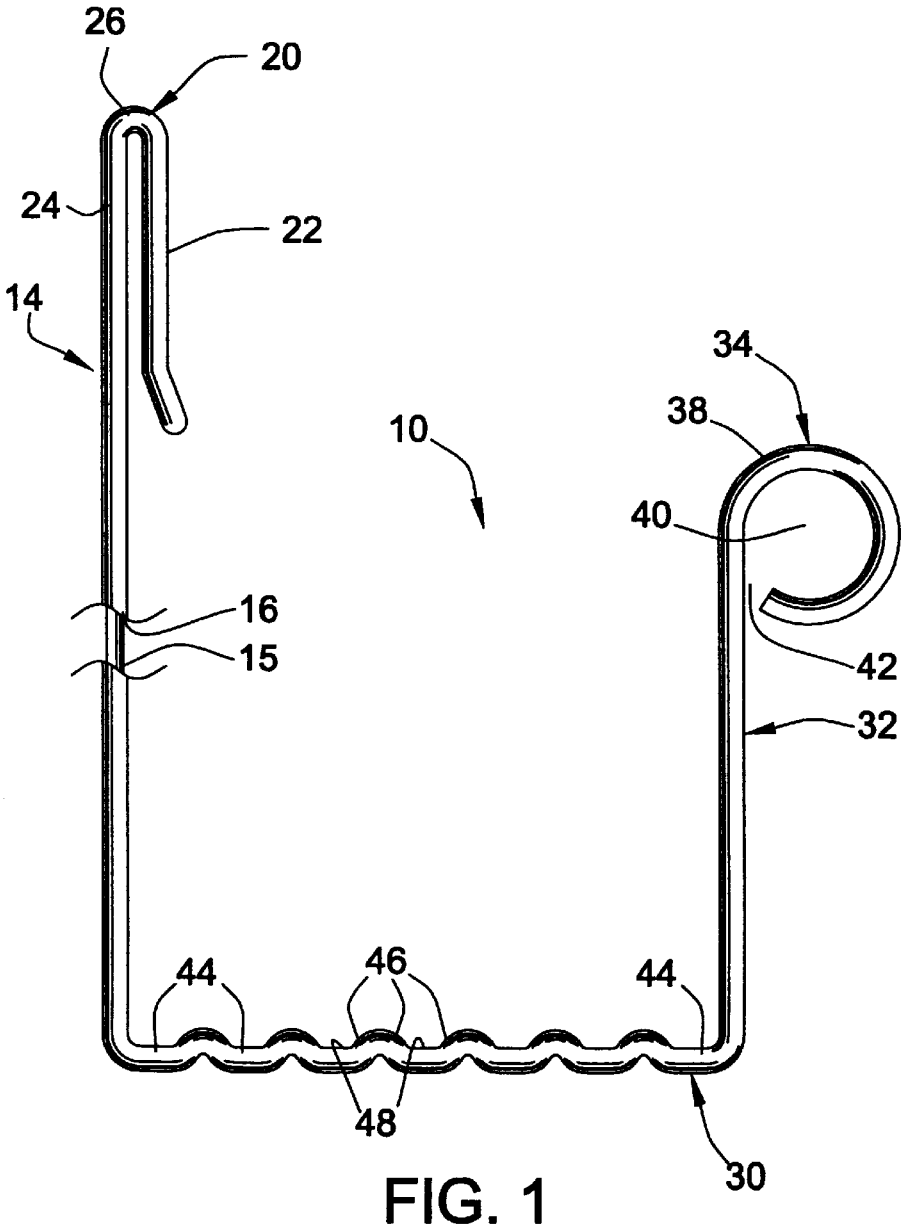
FIG. 1 is a side view of a hanger according to the present invention.
Figure 2:
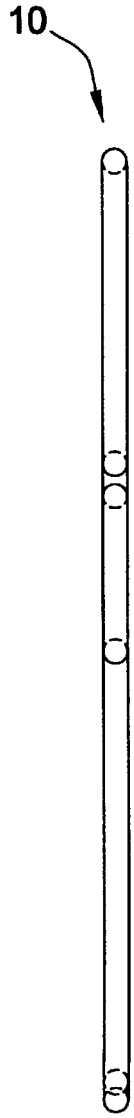
FIG. 2 is an end view of the hanger shown in FIG. 1.
Figure 3:
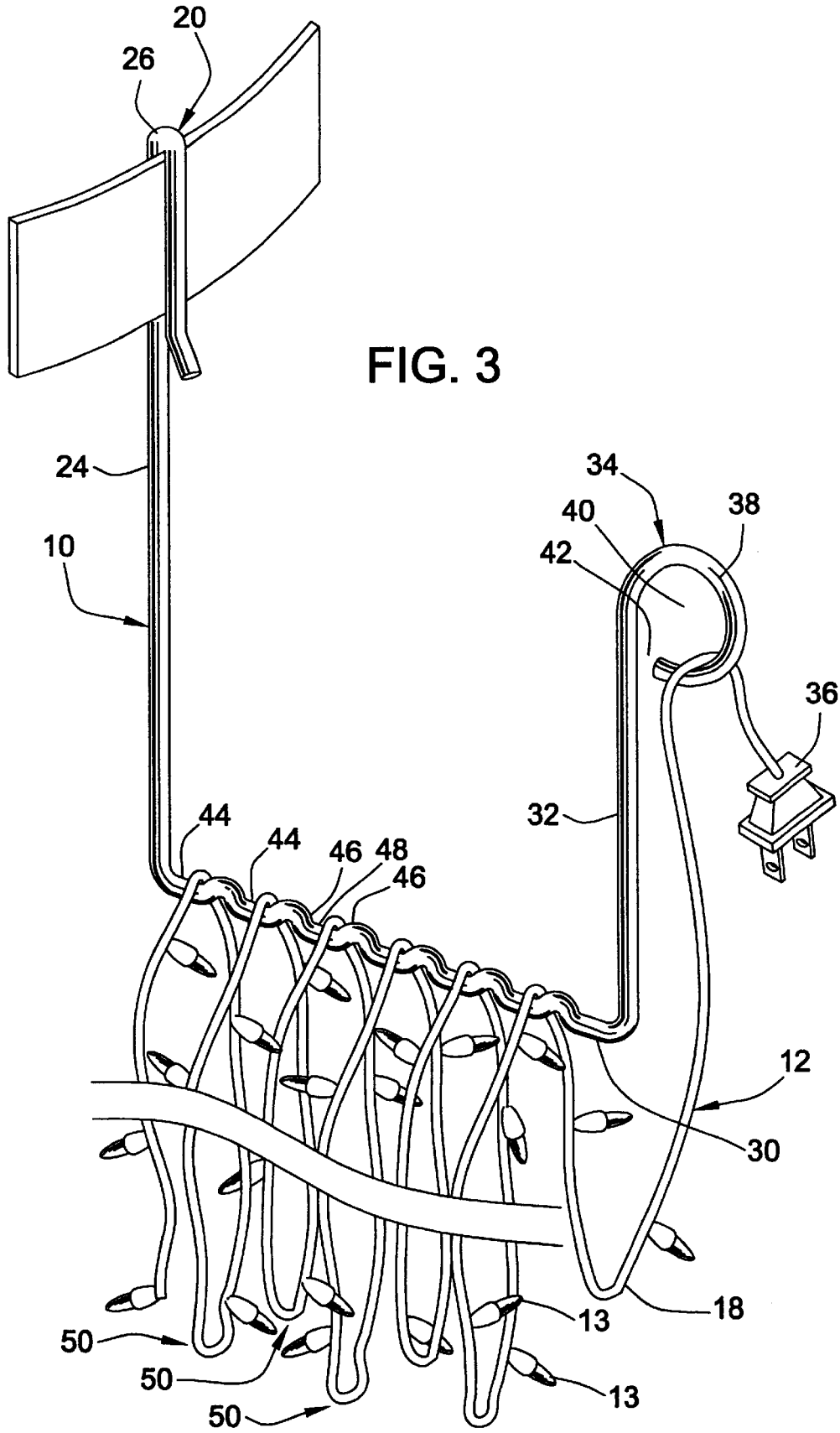
FIG. 3 is a perspective view of the hanger illustrated in the previous Figures with multiple loops of holiday looped around the hanger.
Figure 4:
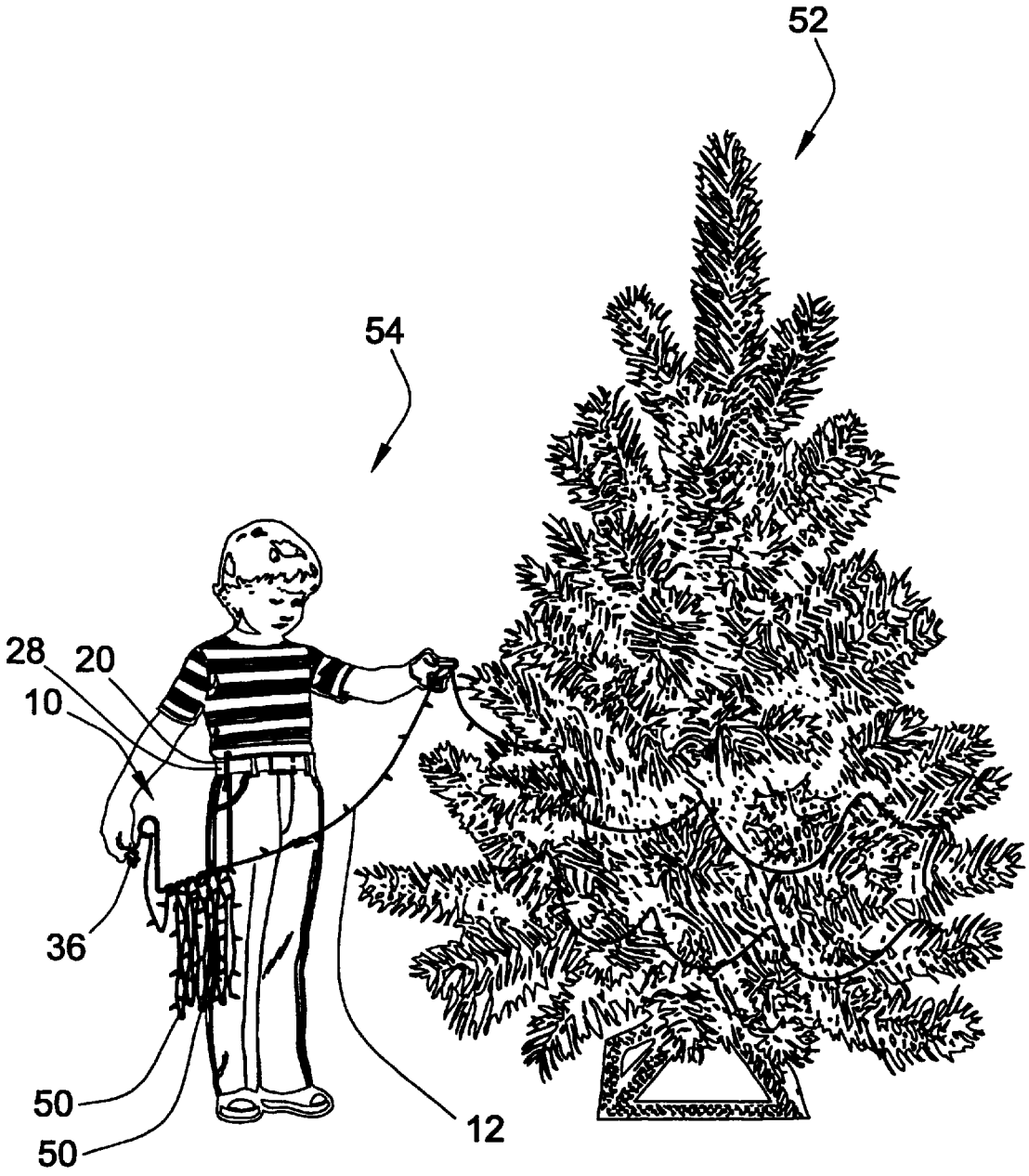
FIG. 4 is a perspective illustration of a person hanging holiday lights on a Christmas tree utilizing the hanger (note: relative sizes of the tree, the hanger and person are not to scale).

Referring to FIG. 1, a preferred embodiment of the present invention is depicted as a hanger 10 adapted to receive multiple loops of cordage, which is illustrated in the preferred form of a string 12 of holiday lights (FIGS. 3 and 4). A string 12 of holiday lights typically comprises an electrical cord 18 having individual lights 13 spaced thereon and a plug 36 at its ends for electrical connection. In the preferred embodiment, the hanger 10 is formed from a thick insulated wire frame 14 to provide a relatively thin and compact structure capable of adequately supporting the weight of the string 12 of holiday lights without substantially bending. It will be appreciated that other materials may also be used such as a thick web of plastic or a thick wooden structure. The wire frame 14 includes a formed steel wire 15 encapsulated in insulating material 16 so that any frays or exposed live wires in the electrical cord 18 do not cause electrical shock to the person mounting the holiday lights.

The hanger includes a mount in the form of a belt clip 20 that is adapted to be temporarily mounted on any sized belts. The belt clip 20 includes a pair of vertical legs 22, 24 depending downwardly from a connecting elbow 26. As shown in FIG. 4, the outermost leg 22 hooks around the belt 28 such that the elbow 26 is adapted to rest on the top surface of a belt 28. Although the preferred embodiment hooks onto a belt, other mounts may also be used including clips or clamps that grab onto clothing and the like.

The hanger 10 also includes a cantilevered horizontal arm 30 joined to the bottom end of inner leg 24. The horizontal arm 30 projects horizontally outward from the leg 24 and generally perpendicularly thereto such that the arm 30 is substantially parallel to the horizontal plane so that the string 12 of holiday lights rest at spaced intervals on the arm and do not bunch up at either the near or far end of the arm. The tip end 32 of the arm 30 is bent vertically upward to act as a stop to prevent loops of the string of holiday lights from falling off the end of the arm.

It is an aspect of the present invention that the a retaining structure 34 is provided on the tip end 32 of the arm 30 for temporarily securing the plug 36 of the electrical cord 18 to prevent the loops 50 (see FIG. 3) of holiday lights from unraveling from the hanger 10. In the preferred embodiment, the retaining structure 34 takes the form of a ring 38 defining an opening 40 having a diameter less than the width of the plug 36 such that the plug is unable to slide through the opening 40. The ring 38 is not fully closed and includes a slot 42 formed between the terminating end and an intermediate portion of the wire frame 14. The slot 42 is wide enough to allow the electrical cord to be slid therethrough such that the plug 36 can be trapped and then released when so desired. Although one form of retainer has been illustrated, it will be appreciated that other retainers can also be used such as a clamp for example which clamps onto the electrical cord or the plug for temporary securement.

It is another aspect of the present invention that a plurality of detents in the preferred form of a plurality of notches 44 are formed vertically into the arm 30. The notches 44 are spaced out along the arm 30 and provide partitions to separate on loop of cordage from another adjacent loop to maintain organization and prevent tangling of the individual loops. Each notch 44 includes opposed slightly angled vertical walls 46 for limiting lateral movement of the individual loops of cordage, and a base 48 therebetween for providing a seat or resting surface for the cordage. The number of notches 44 formed into the wire frame 14 depends upon the overall length of the cordage and the average height of a person, but between about four to eight notches should suffice for most applications.

Turning to FIG. 3, a kit including a string 12 of holiday lights in combination with the hanger 10 are illustrated set up in an already looped condition. In this illustration, the sting 12 of holiday lights has been manually looped around the hanger 10 to form multiple loops 50 hanging from the hanger 10. The individual loops 50 are separated by the notches 44 which organizes the loops around a horizontal axis in a somewhat helical pattern. The light bulbs 13 on the electrical cord 18 can also engage the base 48 and/or the vertical walls 46 of each notch to prevent the electrical cord 18 from slipping and undesirably tightening the loops 50. It should be noted that the combination of the hanger 10 with a string 12 of holiday lights can be sold as a single unit in a single sellable package which helps induce purchasers to purchase one brand of holiday lights over another brand.

Turning to FIG. 4, a method of using the hanger 10 to hang a string 12 of holiday lights on one such structure is illustrated. In this embodiment, the structure is illustrated as a Christmas tree 52, however, it will be appreciated that the structure may be outside bushes or trees, the outside or inside walls of a building, the ceiling of a building, the roof of a building or any other appropriate structure. Fastening mechanisms may be sued to secure the lights to certain structures. The method first comprises arranging loops 50 of the holiday lights on the hanger 10 as shown in FIG. 3 and mounting the hanger 10 on the belt 28 of a person 54 with the belt clip 20 as shown in FIG. 4. The plug 36 may also be temporarily secured in the retainer 34. Then, individual loops 50 of the holiday lights may be unwound from the hanger 10 and then hung on the Christmas tree 52. The individual loops 50 are unwound as necessary to provide slack in the line which then can be fed up and hung on the tree 52. The hanger can also be used to remove the holiday lights from the tree 52. In this manner, the holiday lights are removed from the tree and wound onto an empty hanger 10. The lights are sequentially wound into loops 50 and placed in separate notches 44 to partition the loops and maintain organization of the string of holiday lights. Then, the string 12 of holiday lights organized on the hanger 10 may be stored away until the next holiday season. At that later date, the string of holiday lights are then already organized for easy placement on the desired structure.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A hanger for installing flexible cordage, comprising:

a mount adapted to be temporarily secured on a person;

an arm extending horizontally from the mount, the arm adapted to hold loops of the cordage;

a retainer adapted to hold the one end of the cordage; and wherein the arm includes a plurality of partitioning detents, each detent including spaced apart vertical walls such that each detent is adapted to hold the cordage therebetween.

2. The hanger of claim 1 wherein the mount comprises a belt clip comprising a pair of vertically extending legs joined by an elbow and spaced apart at a horizontal distance sized to receive a belt therebetween.

3. The hanger of claim 1 wherein the hanger is made from an insulated metal wire frame.

4. A hanger for installing flexible cordage, comprising:

a mount adapted to be temporarily secured on a person;

an arm extending horizontally from the mount, the arm adapted to hold loops of the cordage;

a retainer adapted to hold the one end of the cordage; and wherein the cordage includes a plug, and wherein the retainer comprises a ring defining a central opening sized smaller than the plug, the ring including a slot sized larger than the thickness of the cordage to allow insertion of the cordage through the slot.

5. A hanger for installing cordage, comprising:

a mount adapted to be temporarily secured on a person;

an arm extending horizontally from the mount, the arm adapted to hold loops of the cordage; and a plurality of partitioning detents formed into the arm, each detent including spaced apart vertical walls such that each detent is adapted to hold the cordage therebetween.

6. The hanger of claim 5 wherein the cordage includes a plug, and further comprising a retainer comprising a ring defining a central opening sized smaller than the plug, the ring including a slot sized larger than the thickness of the cordage to allow insertion of the cordage through the slot.

7. The hanger of claim 5 wherein the mount comprises a belt clip comprising a pair of vertically extending legs spaced apart at a horizontal distance sized to receive a belt therebetween.

8. The hanger of claim 5 wherein the hanger is made from an insulated metal wire frame.

9. A hanger for installing electrical cordage having a plug at its end, comprising:

a belt clip comprising a pair of vertical legs spaced apart at distanced sufficient to receive a belt therebetween, the vertical legs being joined through an elbow at their top ends;

a cordage holding arm projecting horizontally from the bottom end of one of the legs, the arm including a tip spaced apart from the connected leg and projecting vertically upward to form a receiving area therebetween for receiving loops of cordage;

a plurality of notches formed into the arm, each notch including spaced apart vertical walls joined by a base such that each notch is adapted to hold the cordage therebetween;

a retainer on the tip of the arm, the retainer comprising a ring defining a central opening sized smaller than the plug, the ring including a slot sized larger than the thickness of the cordage to allow insertion of the cordage through the slot; and wherein the belt clip, the arm, and the retainer are formed integrally from a formed insulated wire frame.

10. An holiday light installation kit for hanging holiday lights on a structure, comprising:

a hanger including a mount adapted to be temporarily secured on a person and a horizontally extending arm adapted to hold cordage; and a string of holiday lights adapted to be looped around the arm of the hanger.

11. The holiday light installation kit of claim 10 wherein the hanger includes a retainer adapted to hold the one end of the cordage.

12. The holiday light installation kit of claim 10 wherein the cordage includes a plug, and wherein the retainer comprises a ring defining a central opening sized smaller than the plug, the ring including a slot sized larger than the thickness of the cordage to allow insertion of the cordage through the slot.

13. The holiday light installation kit of claim 10 wherein the arm includes a plurality of partitioned detents, each detent including spaced apart vertical walls such that each detent is adapted to hold the cordage therebetween.

14. The holiday light installation kit of claim 10 wherein the mount comprises a belt clip comprising a pair of vertically extending legs spaced apart at a horizontal distance sized to receive a belt therebetween.

15. The holiday light installation kit of claim 10 wherein the hanger is made from an insulated metal wire frame.

16. A method of manually installing flexible cordage on a structure, comprising:

looping the cordage around a hanger into multiple loops;

mounting the hanger on a person; and unlooping the loops of cordage from the hanger as necessary to allow manual installation of the cordage on the structure.

17. The method of claim 16 wherein the step of mounting is conducted prior to the step of looping.

18. The method of claim 16 wherein the step of mounting comprises hooking the hanger to a belt worn by the person.

19. The method of claim 16 further comprising partitioning the loops via a plurality of horizontally spaced apart detents form into the hanger, each detent including spaced apart vertical walls to holds the cordage therebetween.

20. The method of claim 16 wherein the cordage comprises a string of holiday lights.

21. The method of claim 20 wherein the string of holiday lights includes a plug, further comprising temporarily securing the plug with a plug retainer provided by the hanger.

22. The method of claim 20, wherein the hanger is dismounted from the person after all lights have been strung on the structure, and further comprising:

remounting the hanger on the person at a later date;

removing the string of holiday lights from the structure; and looping the holiday lights on the structure in multiple loops as the string of holiday lights are removed.

23. The method of claim 22 further comprising:

storing the hanger with the holiday lights looped thereon until it is desirable to install the holiday lights again on a structure.

* * * * *